US006729082B1

(12) United States Patent
Oldham

(10) Patent No.: US 6,729,082 B1
(45) Date of Patent: May 4, 2004

(54) INWARDLY PROJECTING WINDOW

(76) Inventor: Dick J. Oldham, E6512 W. Fork, Viroqua, WI (US) 54665

( * ) Notice: Subject to any disclaimer, the term of this patent is extended or adjusted under 35 U.S.C. 154(b) by 0 days.

(21) Appl. No.: 10/172,639

(22) Filed: Jun. 14, 2002

(51) Int. Cl.[7] ..... E06B 1/38

(52) U.S. Cl. ..... 52/201; 52/204.1; 52/213; 52/786.1

(58) Field of Search ..... 52/201, 204.1, 52/213, 786.1; 49/61, 68, 72, 142, 504, 501, 475.1, 507

(56) References Cited

U.S. PATENT DOCUMENTS 400,605 A * 4/1889 Scholfield
884,404 A * 4/1908 Morris
2,626,432 A * 1/1953 Williams
3,074,125 A * 1/1963 Miller
3,227,206 A * 1/1966 Rocco et al.
3,561,176 A * 2/1971 Silterly
4,009,546 A * 3/1977 Buck, Jr. ..... 52/201
4,643,246 A * 2/1987 Ikemura et al. ..... 165/54
4,881,491 A * 11/1989 Brown ..... 119/51.01
5,063,717 A * 11/1991 Quaranta et al. ..... 52/201
5,099,623 A * 3/1992 Smith et al. ..... 52/201
5,142,819 A * 9/1992 Sung ..... 47/40
5,458,287 A * 10/1995 Jones et al. ..... 232/43.1
6,062,167 A 5/2000 Soley
6,192,643 B1 * 2/2001 Zadok ..... 52/648.1
6,560,937 B1 * 5/2003 Gardner et al. ..... 52/201

* cited by examiner

*Primary Examiner*—Jeanette Chapman
(74) *Attorney, Agent, or Firm*—Boyle Fredrickson Newholm Stein & Gratz S.C.

(57) ABSTRACT

A window is configured to bring nature into the interior of a building in a true physical sense. The window includes a frame configured to be permanently mounted to a perimeter of an opening in the wall of the building, an at least partially open exterior surface, an interior surface that is positioned inwardly of the interior surface of the wall, and a base and a top, each of which extends from the frame to the interior surface of the window. The interior surface of the window is formed from a plurality of interconnected sashes, at least some of which may be operable to provide access to the inwardly projecting alcove of the window from within the building. The inwardly projecting alcove of the window may contain accessories that may be mounted on the window using a convenient bracket that facilitates positioning of the accessories in the window and removal of the accessories for cleaning or maintenance.

12 Claims, 8 Drawing Sheets

INWARDLY PROJECTING WINDOW

BACKGROUND OF THE INVENTION

1. Field of the Invention

The invention relates to windows and, more particularly, relates to a window that is configured for permanent mounting in an opening in an exterior wall of a dwelling or other building and that projects inwardly into the interior of the building so as to bring the outdoors into the building in a true physical sense.

2. Background of the Invention

Building designers frequently incorporate structures in both commercial and residential buildings to bring elements of the outdoors into working or living spaces. For instance, skylights, sunrooms, atriums, etc., are being used with increasing frequency and in a variety of settings. Large picture windows, bay windows, and bow windows are also increasingly commonplace. All of these structures are designed to permit natural light to enter the building. Many are also designed to permit occupants of the building to view flora and fauna located outside of the building. This latter goal is especially important in applications in which occupants of the building do not have ready access to natural outdoor attractions, either because the occupants cannot readily leave the building and/or because natural attractions are not readily accessible from the building due to its location. These applications include nursing homes, elderly care facilities, schools, libraries, buildings located in cold climates, high rise buildings, and even low rise buildings in urban settings.

A serious drawback of virtually all structures of the type described above is that they do not bring nature indoors in a true physical sense. They instead present a glass or other transparent partition that isolates the exterior of the building from nature. In the case of atriums, skylights, traditional windows, etc., this partition is at least generally coplanar with the exterior surface of the building. In the case of bow windows and bay windows, the partition is disposed outwardly of the outer surface of the building. Hence, birds, plants, small animals, and other natural attractions are not allowed to venture into the confines of the outer shell of the building. Occupants of the building therefore can view these attractions from only a relatively long distance. In most cases, the occupant also cannot access the interior of the structures from within the building in order to replenish food, water plants, clean or refill accessories, etc. They instead must venture outside of the building—an impossibility for infirm persons and/or for high rise occupants and other persons for whom the outside of the structure is simply inaccessible.

Attempts have been made to alleviate at least some of the problems addressed above. For instance, U.S. Pat. No. 6,062,167 to Soley discloses a bird feeder kit configured for mounting within a window so as to attract birds to a location that is easily viewed from within a building and so as to permit the feeder to be filled, cleaned, etc. from within the building. The bird feeder includes a frame and a viewing enclosure that is mounted in the frame. The frame is configured to be removably mounted in an existing window opening. The viewing enclosure has a transparent window portion that supports a bird feeder within it and that is pivotally mounted on the frame so that an occupant of the building can selectively pivot the bird feeder into the building for refilling or cleaning purposes.

While the bird feeder disclosed in the Solely patent has advantages over standard windows and the like, it does not solve all of the problems of those earlier structures and presents additional problems of its own. For instance, because it is configured to be supplied as a kit that is mountable in an existing window opening in a retrofit structure, it is necessarily relatively small in length, height, and depth. The size constraints, and particularly the depth constraints, considerably reduce the ability of occupants of a building to view feeding birds. In fact, any occupant other than one sitting directly in front of the viewing enclosure is unlikely to be able to view feeding birds. It is also relatively flimsy, easy to inadvertently displace, and poorly insulated. Moreover, the entire arrangement is configured solely for use as a bird feeder and, accordingly, cannot bring plants, animals, or other aspects of nature indoors. It also is not well-suited for cooperation with other internal building structures such as cabinets, etc.

The need therefore has arisen to provide a permanent, sturdy structure that is configured to be mountable in an opening of a building so as to bring nature into the building in a true physical sense.

SUMMARY OF THE INVENTION

In accordance with a first aspect of the invention, a window is configured to bring nature into the interior of a building in a true physical sense. A preferred window includes a frame configured to be permanently mounted to a perimeter of an opening in an exterior wall of the building, an at least partially open exterior surface that is configured to be located outwardly of the interior surface of the wall and to face the outdoors, an interior surface that is positioned inwardly of the interior surface of the wall to form an inwardly projecting alcove between the interior and exterior surfaces of the window, and a base and a top, each of which extends from the opening to the interior surface. The interior surface is preferably formed from a plurality of interconnected sashes, at least some of which may be operable to provide access to the interior of the window from within the building. The interior of the window may contain accessories that may be mounted on the window using a convenient universal bracket that facilitates positioning of the accessories in the window and removal of the accessories for cleaning or maintenance.

Preferably, the window includes a sill, a head jam, and/or other components formed from a relatively smooth, wipeable material. The window may additionally be supported on the building by at least one of a) a stand located adjacent the interior surface of the wall and attached to the base and b) a strut attached to the interior surface of the building and to one of the base and the top. If the base is supported on a stand, the stand may also perform a secondary function such as to serve as a cabinet.

In accordance with another aspect of the invention, a bracket usable with a window of the type described or other structures includes a base configured for attachment to the window and a support arm having i) a first end portion that is attachable to the base, ii) a second end portion that is configured to support an accessory, and iii) a body portion that leads from the first end portion to the second end portion. The body portion preferably is bent through an angle of approximately 90°. In order to facilitate orientation or reorientation of the bracket and the mounted accessory, the first end portion of the arm may be is pivotally mountable on the base.

The bracket preferably additionally includes an accessory mount on which the accessory can be mounted and which is slidably mountable onto the second end portion of the arm.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Construction and Operation of First Embodiment

Figure 2:
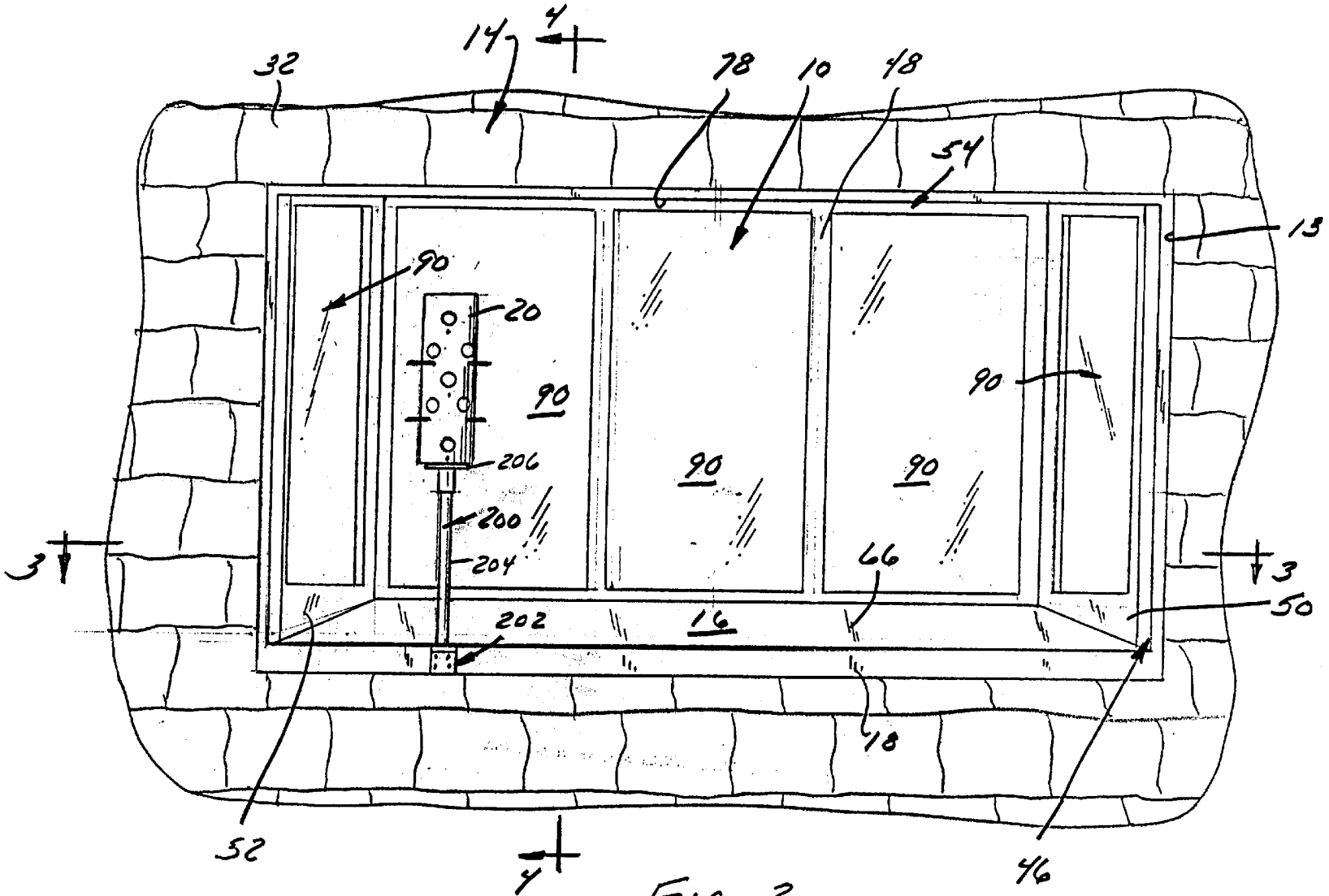
FIG. 2 is an elevation view of the window and the surrounding building portion of FIG. 1, viewed from outside the building.
Figures 3, 3A, 3B:
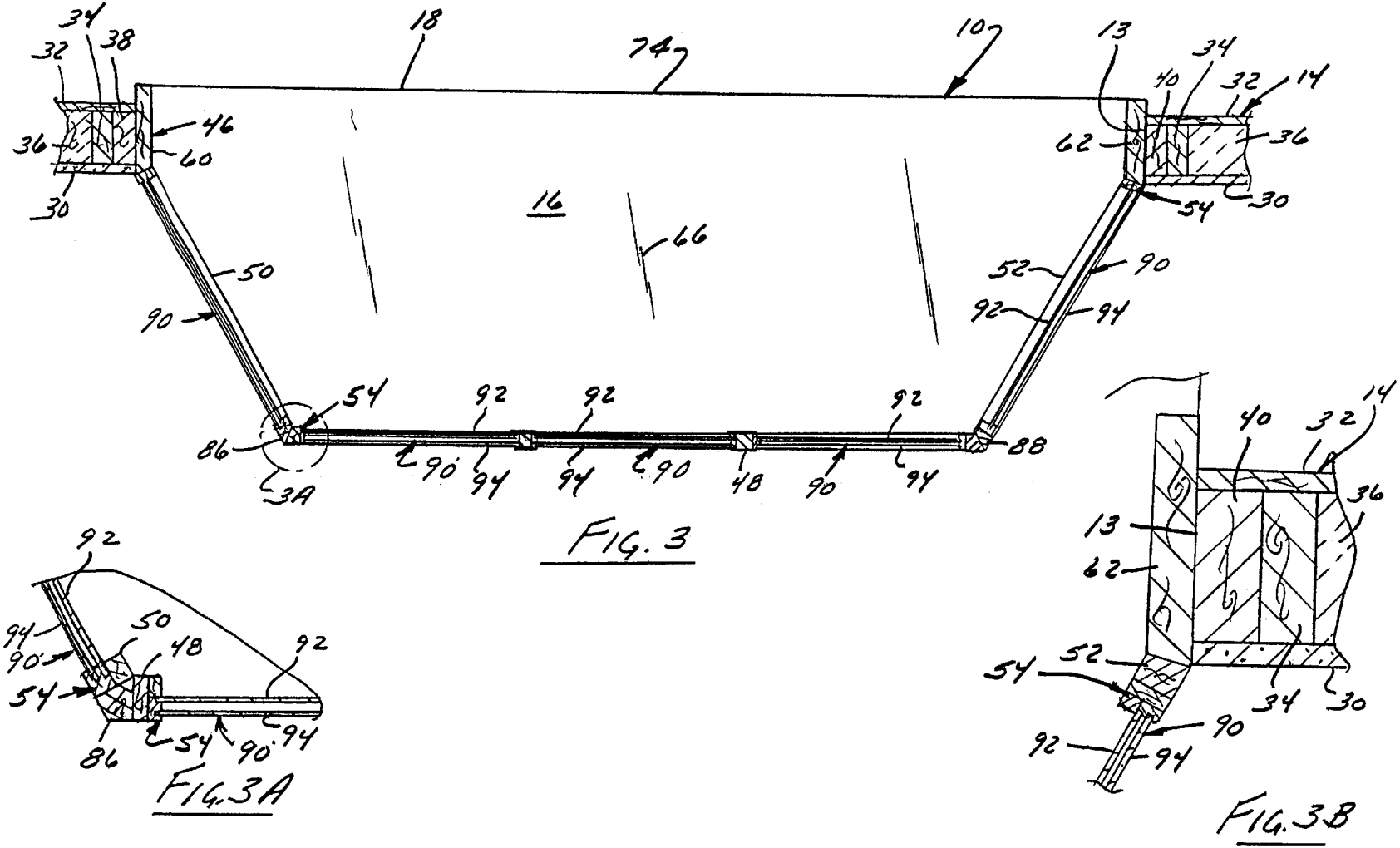
FIG. 3 is a sectional plan view taken generally along the line 3—3 in FIG. 2.
FIGS. 3A and 3B are detail views of the areas designated 3A and 3B, respectively, in FIG. 3.
Figure 4:
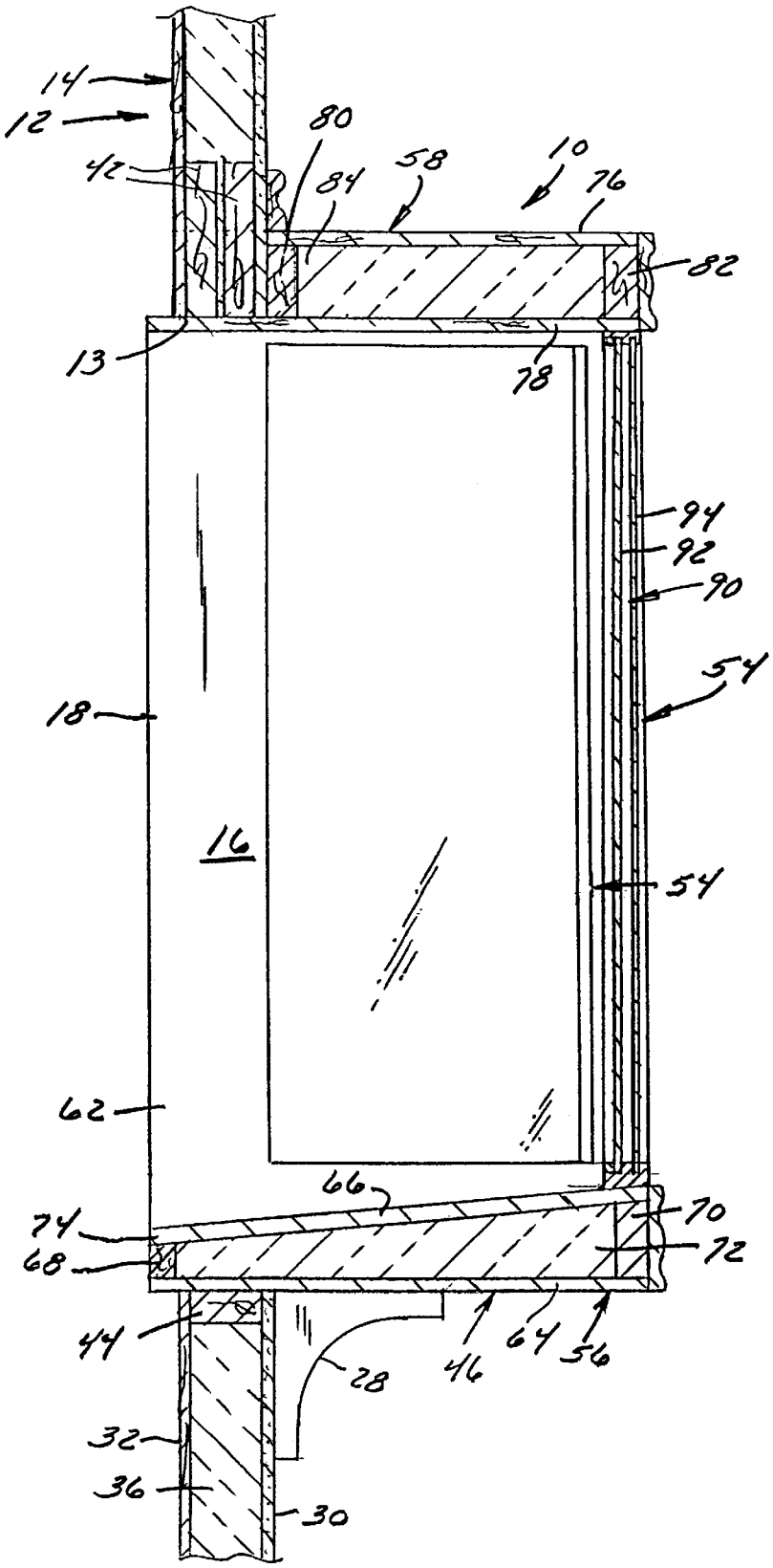
FIG. 4 is a sectional elevation view taken generally along the line 4—4 in FIG. 2.

As should be apparent from the Summary portion above, the invention is applicable to virtually any permanent window that projects into a dwelling or other building and that is at least partially open at its exterior surface so as to bring nature into the interior of the building in a true physical sense. An example of a window meeting these characteristics is illustrated in FIGS. 1–4 in the form of a bay-type window 10. The window 10 is permanently mounted in an opening 13 of an exterior wall 14 in a building 12 and projects into the interior of the building 14 to produce an inwardly projecting alcove 16 located within the building 12. The amount of projection may vary dramatically depending, e.g., on the size and shape of the window. The typical inwardly projecting alcove will be at least 6" deep as measured from the interior surface 30 of the wall 14 to the interior surface of the window 10. It will most typically be about 16" deep, but could be deeper. It could also be shallower in some applications, having a depth of as little as 3" or even less. In the illustrated embodiment, an exterior surface 18 of the window 10 is completely open so as to allow unrestricted access to the outdoors from within the window 10. It is conceivable, however, that the exterior surface 18 of the window 10 might not be completely open but, instead, could have a partition or the like, etc. The alcove 16 of the window may be unadorned but, preferably, contains accessories 20 designed to represent and/or attract nature, such as wind chimes, flowerpots, a bird feeder, etc. One or more of these accessories may be mounted on the window using a convenient universal bracket 200 of the type detailed in Section 3 below. A cabinet 22, preferably having a size and shape matching that of the window 10, is positioned beneath the window, both for aesthetics and to act as a stand that helps support the weight of the cantilevered or partially cantilevered window 10. The cabinet 22 may have doors 24, shelves 26, and/or any structures typical to such cabinets. In addition to or instead of the cabinet 22, support for the cantilevered window 10 may be provided by one or more struts 28 which, as seen in FIG. 4, extend from the wall 14 to approximately the center of the bottom of the window 10. The struts may be supplemented by other struts or other supports (not shown) extending from the top of the window 10 to the wall 14 and/or ceiling (not shown).

Figure 1:
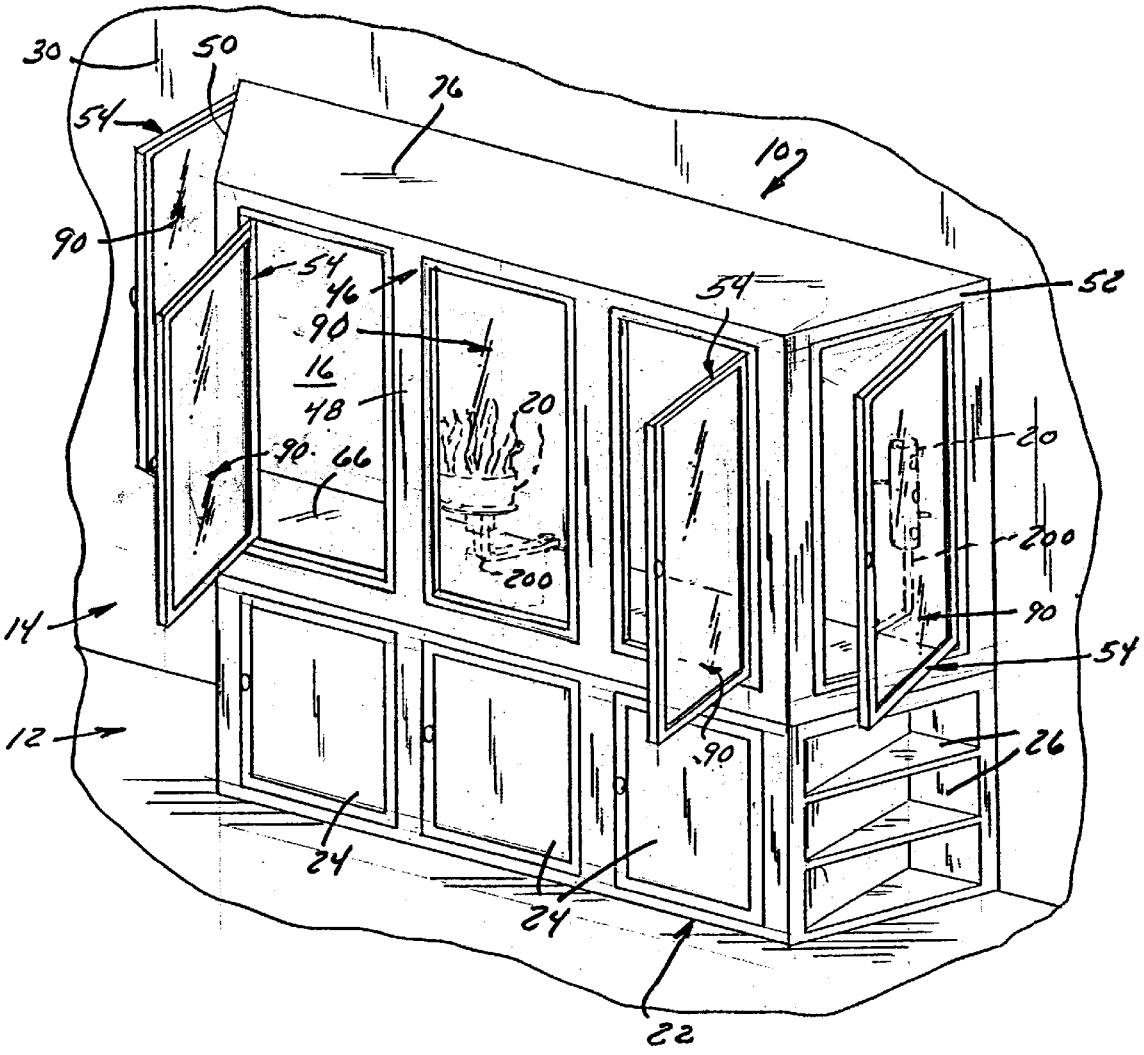
FIG. 1 is a perspective view of a window and the surrounding portion of an associated building constructed in accordance with a first embodiment of the present invention, viewed from inside the building.

The building 12 may comprise a private residence, an apartment building or condominium, a hospital, a nursing home or elderly care facility, a retail or commercial business establishment, school, library or any other setting in which the building's occupants have the desire to view natural attractions from within the building. The wall 14 may be of any construction typically used in such buildings. It will typically have interior and exterior surfaces 30 and 32 formed from different materials and connected to one another by supports 34 that span a gap between the two surfaces. However, the supports 34, exterior surface 32, and/or interior surface 30 may all be formed from the same element in some applications such as when the building is constructed from hollow block and at least one of the interior and exterior surfaces of the building is formed from a corresponding surface of that block. In the illustrated embodiment, the interior surface 30 is formed from drywall sheets or the like as seen in FIG. 1, the exterior surface 32 is formed from shakes as best seen in FIG. 2, and the supports 34 spanning the gap between the interior and exterior surfaces 30 and 32 comprise 2"×4" or 2"×6" framing studs as seen in FIGS. 3 and 4. As also seen in FIGS. 3 and 4, the gap between the studs 34 is filled with insulation 36.

Referring particularly to FIGS. 3 and 4, the opening 13 is dimensioned to be commensurate in area with the external area of the window 10 such that the window 10 completely fills the opening 13. The perimeter of the opening 13 is surrounded by structural supports for mounting the window 10 thereto. The supports may vary in configuration, material, and shape with wall construction, window construction, window size, etc. The supports of this embodiment comprise left and right vertically extending wooden framing studs 38 and 40 as best seen in FIGS. 3 and 3B, an upper horizontally extending header 42 as best seen in FIG. 4, and a lower horizontally extending sill plate 44 also as best seen in FIG. 4. A window frame 46 is permanently attached to the supports 38, 40, 42, and 44, e.g., by nailing. Although none is illustrated, the juncture between the window frame 46 and the interior and exterior surfaces 30 and 32 of the wall 14 may, if desired, be covered with molding or flashing to enhance the aesthetic appearance of the window 10 and surrounding portions of the wall 14.

The window 10 may take any of a great number of configurations, so long as it projects into the building 12 and has an at least partially open exterior surface 18 so as to allow direct visual access to the outdoors by occupants of the building 12 and direct physical access to the alcove 16 of the window 10 from the outdoors. Hence, the portion of the window 10 projecting into the building 12 could be curved, angular, polygonal, etc. The number of sashes and/or the overall height, width, and/or length of the window 10 may vary dramatically from application to application. Some or all of the window sashes 54 may be either operating or non-operating.

In the embodiment of FIGS. 1–4, the window 10 comprises a bay-type window. It has a rectangular exterior surface 18 profile that is completely open and a segmented inwardly projecting alcove 16. The exterior surface 18 should be positioned outwardly of the interior surface 30 of the wall 14. The exterior surface 18 of the illustrated embodiment is generally coplanar with the exterior surface 32 of the wall 14 and has an area of about 96" by 44". The alcove 16 is bordered by three apertured panels 48, 50, 52 that extend the length of the window 10 and that support sashes 54 as best seen in FIG. 1. The frame 46 of the illustrated embodiment is wooden but could be constructed from a metal, composite, or any other material capable of supporting itself and the sashes 54 on the opening. It includes a lower platform assembly or base 56, an upper platform assembly -or top 58, and a pair of vertical side jams, 62.

As best seen in FIG. 3, each of the vertical side jams 60, 62 comprises a wooden board that is nailed, screwed, and/or glued to the associated post 38, 40 in the wall 14. Each side jam 60, 62 is slightly wider than the wall 14, is flush with the interior surface 30 of the wall 14, and extends outwardly beyond the exterior surface 32 of the wall 14 by a small distance of, e.g., ½" to 1-½" (alternatively, the outer surface of each side jam 60, 62 and the exterior surface 18 of the window 10 as a whole could be flush with the outer surface of the wall 14).

The base 56 and top 58 of the frame 46 form the main structural supports for the window 10 and, therefore, are of relatively heavy construction. The base 56 is also preferably reinforced by mounting it on the cabinet 22 as seen in FIG. 1 and/or by a strut 28 as seen in FIG. 4 (the cabinet 22 having been removed in FIG. 4 for ease of illustration). As best seen in FIG. 4, the base 56 includes a securing platform 64 formed from plywood or the like, an upper sheet 66 forming a sill of the window 10, and exterior and interior horizontal joists 68 and 70 that span a gap between the securing platform 64 and the sill 66. This gap is preferably filled with insulation 72. Both the securing platform 64 and the sill 66 extend the length and width of the alcove 16 of the window 10. The outer end of the sill 66 presents a ledge 74 acting as a surface for the mounting of hardware such as the brackets 200. It also presents a perch for birds or animals and acts as an overhang that permits the alcove 16 of the window 10 to be wiped or washed clean with reduced runoff onto the underlying portion of the wall's exterior surface 32. The sill 66 may be sloped toward the exterior surface 18 of the window 10 at a relatively shallow angle of, e.g., 5° so as to facilitate washing or wiping of the sill. It also is preferably formed from an easily wipeable material such as faux marble, tile, or another smooth surface.

Still referring to FIG. 4, the top 58 of the frame 46 also is of a two-part construction. It includes a securing platform 76 formed from plywood, or the like, a lower sheet 78 forming a head jam of the window 10, and interior horizontal joists 80 and 82 that span an insulation filled gap (the insulation being shown at 84 in FIG. 4) between the securing platform 76 and the head jam78. As with the sill 66 of the window 10, the head jam 78 extends the length and width of the alcove 16 and may be formed from the same wipeable material as the sill 66. The outer end of head jam78 is flush with the outer edges of the sill 66. Securing platform 76 extends to interior surface 30.

As seen in FIG. 1, in order to provide the desired bay appearance, the panels include a relatively lengthy interior front panel 48 extending in parallel with the interior surface 30 of the wall 14 and a pair of opposed side panels 50 and 52 extending at an angle from the ends of the front panel 48 to the interior surface 30 of the wall 14. In the illustrated embodiment, the side panels 50 and 52 extend at an acute angle of approximately 30° and each are about 20" wide. The front panel 48 is about 80" wide. As best seen in FIG. 3, the outer end of each side panel 50 and 52 is nailed or otherwise connected to a corresponding side support 60 or 62 of the frame 46. As best seen in FIG. 3A, the inner end of each of the side panels 50, 52 is connected to the associated end of the front panel 48 via a generally triangular mullians 86, 88 that links the adjacent panel ends to one another.

As discussed briefly above, at least some of the sashes 54 are preferably operable so as to permit access to the interior of the window by persons in the building. In the illustrated embodiment, all of the sashes 54 are of the casement type so as to be swingable into the building as best seen in FIG. 1. As is conventional, each sash 54 is hinged to the perimeter of a corresponding opening in the associated panel 48, 50, and 52 and that supports a glass pane arrangement. The sashes in each side panel 50 and 52 are about 16" wide by 34" tall. Each sash 54 supports a pane arrangement 90 of a transparent or partially transparent material. The pane material may comprise, e.g., clear or tinted glass, a plastic material, or a mesh material. The chosen pane material should be sufficiently transparent to permit the inwardly projecting alcove 16 to be viewed from the interior of the building. The sashes in the front panel 48 are each about 24" wide by 34" tall. Because the interior of the window 10 is open to the environment, the pane arrangement 90 of each sash 54 is preferably of the type typically used for exterior windows used in climates in which the building 12 is located. The window 10 of the illustrated embodiment is configured for use in relatively cold weather climates, and the pane arrangement 90 is of the so-called double pane construction typically used in such environments. Specifically, inner and outer glass panes 92 and 94 are spaced from one another by a sealed gap containing an insulating layer of air or an inert gas.

In use, occupants of the building 12 may adorn the alcove 16 of the window 10 with any accessories 20 of interest, such as wind chimes, flowerpots, bird feeders, etc. These accessories 20 can be accessed from the interior of the building 12 simply by opening one or more of the sashes 54 and reaching into the interior of the window 10. The window 10 can also be wiped or washed clean from the interior of the building 12, with cleaning being facilitated by the smooth surface of the sill 66 and washing being facilitated by the sloped nature of the sill 66. Because the window 10 projects well into the building 12 and is transparent on all sides, items in the window 10 can be easily viewed from virtually any vantage point within the building 12.

2. Construction and Operation of Second Embodiment

Figure 5:
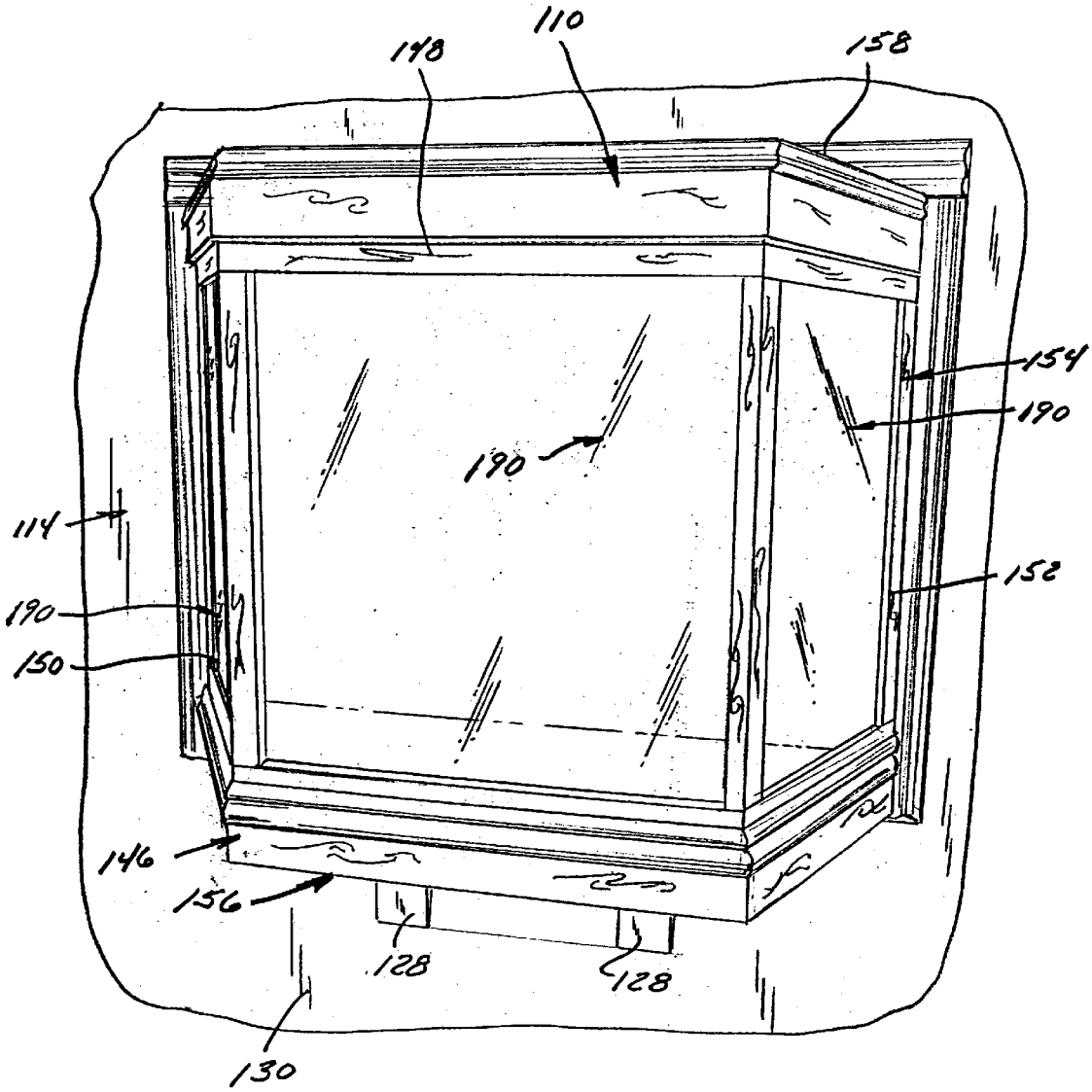
FIG. 5 corresponds to FIG. 1 but illustrates a window constructed in accordance with a second preferred embodiment of the invention.
Figure 6:
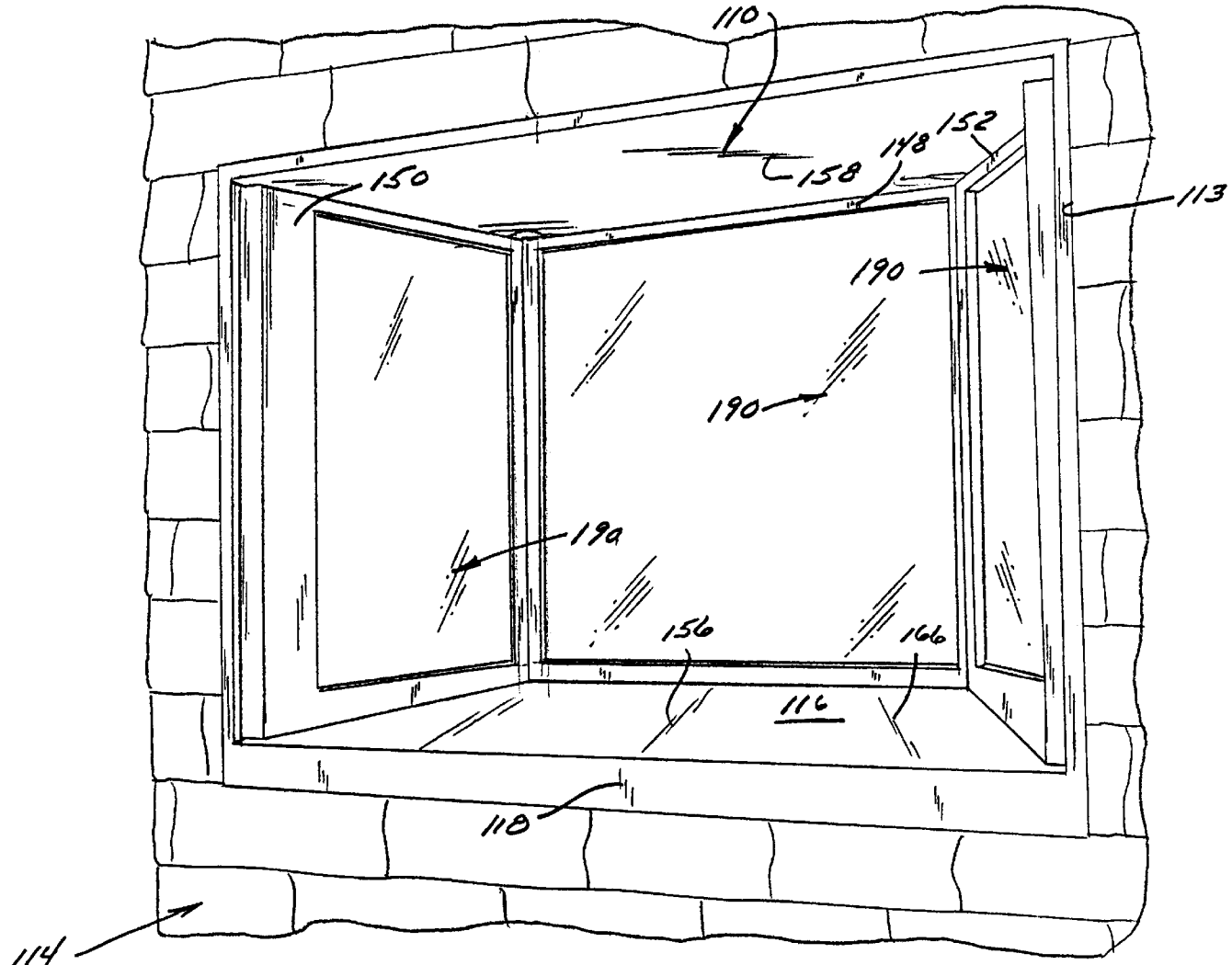
FIG. 6 corresponds to FIG. 2 but illustrates the window of FIG. 5.

As mentioned above, the invention is applicable to a wide variety of window shapes and sizes. To better illustrate this point, a window 110 constructed in accordance with a second embodiment of the invention is illustrated in FIGS. 5 and 6. This window, like the window 10 of the first embodiment, includes a frame 146 mounted in an opening in a wall 114 and a plurality of panels 148, 150, 152 which are mounted on the frame 146 and each of which supports at least one sash 154. The frame 146 includes a base 156, sides, and a top 158 that are all of identical construction to the window of FIGS. 1–4 and, accordingly, will not be described in detail. Suffice it to say, that the cantilevered base 156 of the window 110 is also supported by angled struts 128 leading from the base 156 to the wall 114. However, the window 110 of this embodiment is considerably smaller than the window 10 of the first embodiment. Its exterior dimensions are approximately 48"×44"×24", as opposed to 96"×44"×24" in the first embodiment. It also has only three sashes 154 as opposed to five. A different type of interior molding arrangement is also illustrated to highlight the fact that the inner and outer surfaces of the window 110 can be adorned in virtually any manner desired. The sashes 154 of this embodiment may be operable and are shown in the closed position. The cabinet of the first embodiment is also not employed in this embodiment.

3. Construction and Operation of Mounting Bracket

Figure 7:
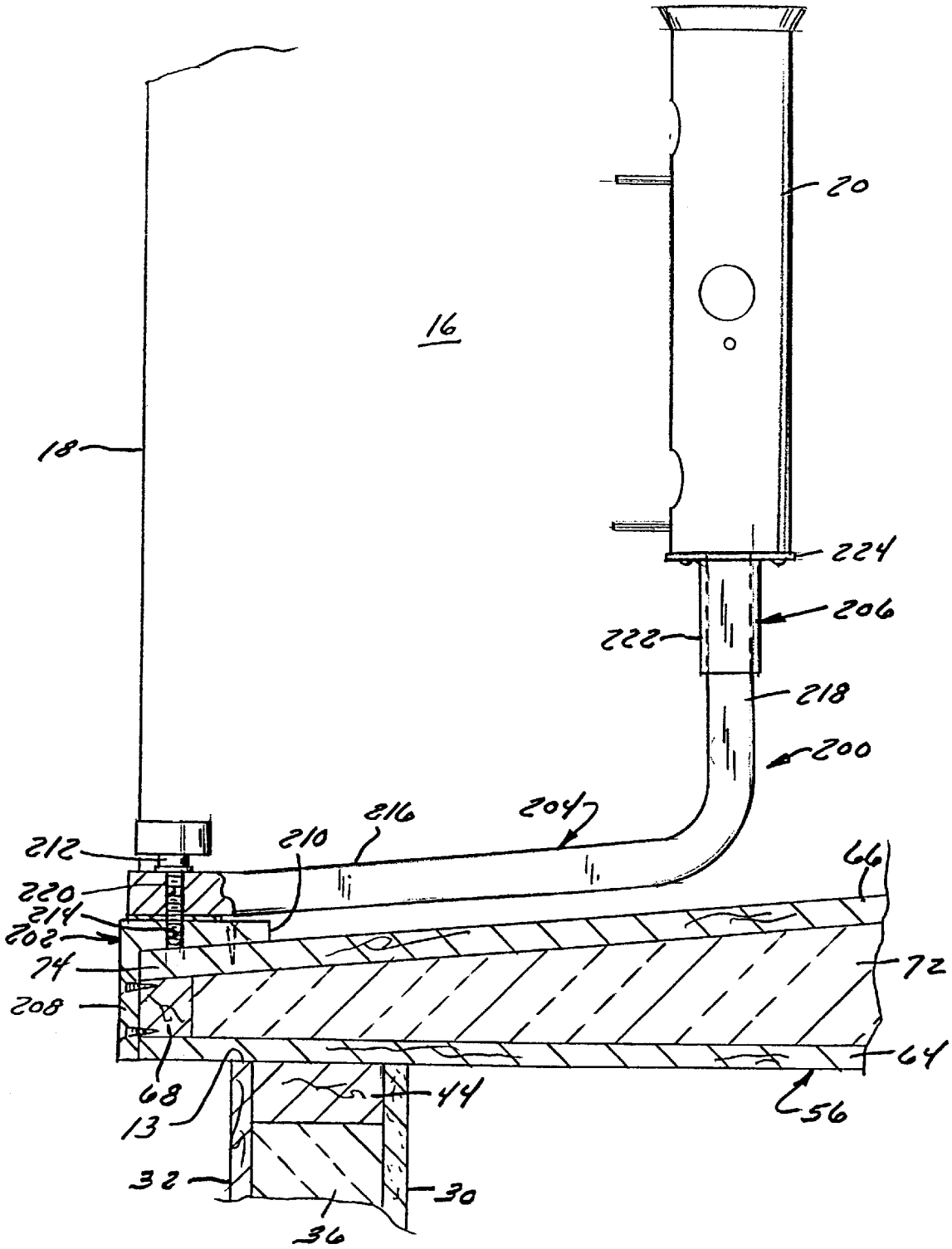
FIG. 7 is a side elevation view of a universal bracket mounted on the floor of the window of FIGS. 1–4 and supporting a window accessory.
Figure 8:
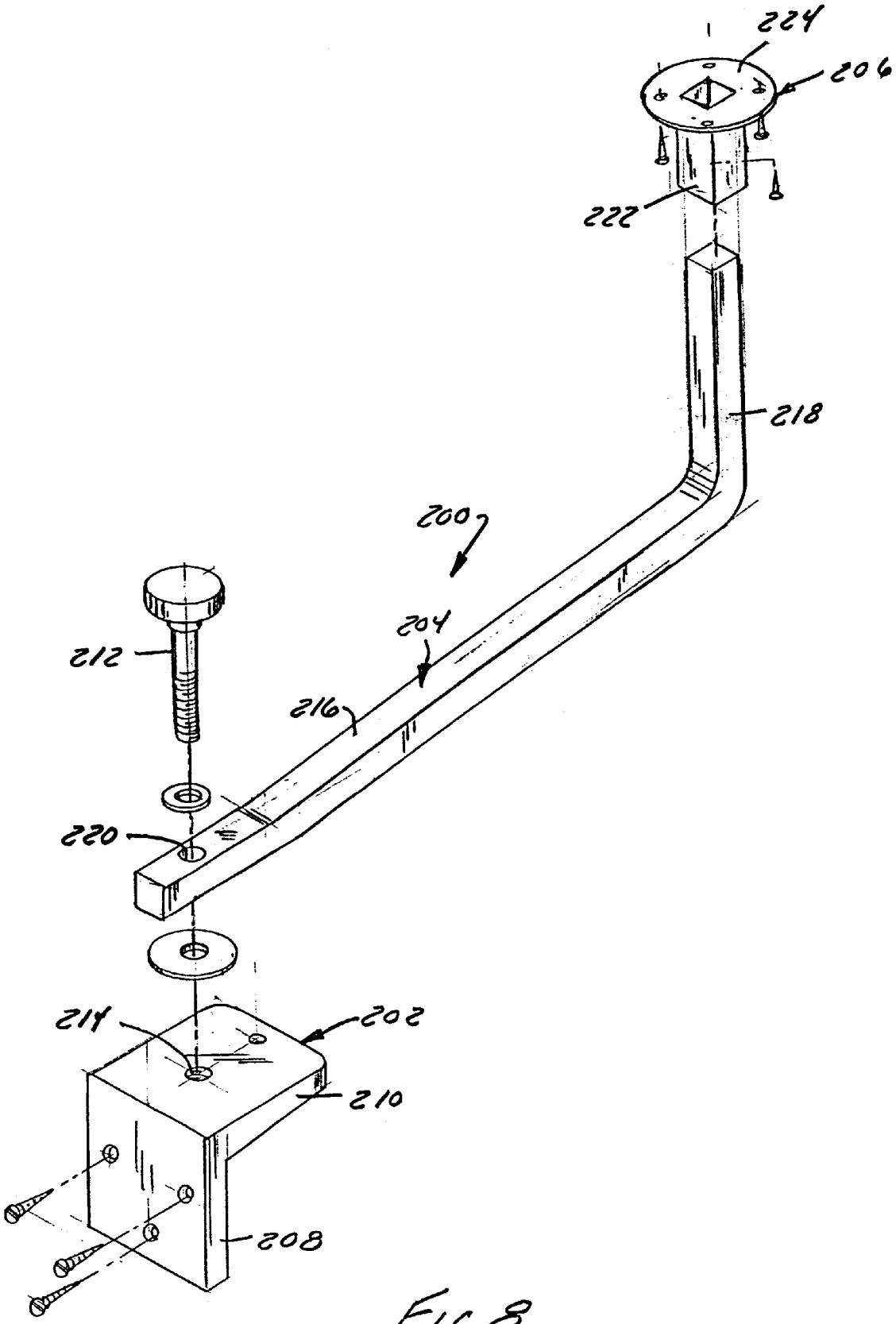
FIG. 8 is an exploded perspective view of the bracket and related components of FIG. 7.

While accessories 20 are mountable within the window 10 or 110 in any desired manner, different accessories 20 can be easily mounted in, removed from, and oriented in the window using a convenient universal bracket 200 that can be mounted on different interior surfaces of the window. The bracket 200, best seen in FIGS. 7 and 8, is usable with the window 10 of FIGS. 1–4, the window 110 of FIGS. 5 and 6, any other window constructed in accordance with the invention, or even in other applications. By way of example, the bracket 200 is shown is being mounted in the window 10 of FIGS. 1–4. It includes a base 202, an arm 204, and an accessory mount 206. The base 202 comprises a universal L-bracket that can be oriented one way as seen in FIG. 7 to mount the arm on the floor 66 of the window 10 or used in the same orientation or rotated 180° to mount the arm 204 on a vertical surface of the window 10. The bracket 202 includes a vertical mounting leg 208 and a horizontal or generally horizontal support leg 210, both of which are screwed to the base of the window 10. Preferably, the arm 204 is not rigidly attached to the bracket 202 but, instead, is pivotally mounted on the support leg 210 by a thumbscrew 212, or other mechanism used to secure it's position, e.g. a cam-lock, that threads into a tapped bore 214 in the support leg 210 so as to permit the user to position the arm 204 in virtually any desired orientation simply by loosening and retightening the thumbscrew 212.

The arm 204 of this embodiment is formed from a square metal rod, but could be formed from a tube. It is bent at an angle of generally 90° at a position intermediate first and second end portions 216 and 218 thereof. The first end portion 216 is mounted on the support bracket 202 by inserting the thumbscrew 212 through a bore 220 in the arm 204 and threading the thumbscrew 212 into the tapped bore 214 in the support bracket 202. The second end portion 218 extends generally vertically from the bend and receives the accessory mount 206. The configuration of the arm 204 may vary based on the size and shape of the window and/or the desired accessory being mounted.

The accessory mount 206 may comprise any structure that is mountable on the second end portion 218 of the arm 204 and that can support an accessory 20. In the illustrated embodiment, the accessory mount 206 comprises a cup-shaped element having a lower tubular support portion 222 and an upper accessory support 224 portion. The tubular support portion 222 is dimensioned to slide snugly over the second end portion 218 of the arm 204. However, if the arm 204 were configured as a tube rather than a rod, the support portion 222 could be dimensioned to fit within the tube rather than to slide over it. If desired, set screws or the like (not shown) could be provided to hinder undesired movement of the accessory mount 206 relative to the arm 204. The support portion 224 comprises a circular flange, that can be formed as an integral part of tubular support portion 222, and has mounting locations for attaching an accessory 20 such as a birdfeeder to the top of the flange 224.

In use, the operator first mounts the bracket 202 at a desired location in or on the window 10. He or she can then mount the first end portion 216 of the arm 204 on the bracket 202 using the thumbscrew 212. The accessory mount 206, having been previously attached to the bottom surface of the accessory 20, is then simply slipped over the second end portion 218 of the arm 204. The accessory 20 can thereafter be removed for cleaning or refilling simply by sliding the accessory mount 206 from the second end portion 218 of the arm 204. The accessory 20 can also be repositioned as desired simply by loosening the thumbscrew 212, pivoting the arm 204 to a new position, and retightening the thumbscrew 212 to retain the arm 204 in its new position.

Many changes and modifications may be made to the invention without departing from the spirit and scope thereof. Many of these changes are discussed above. Other changes will become apparent from a reading of the appended claims.

I claim:

1. A window configured for permanent mounting in an opening in an exterior wall of a building, the wall having an interior surface and an exterior surface, said window comprising:

(A) a frame configured to be permanently mounted to a perimeter of the opening;

(B) an at least partially open exterior surface that is configured to be positioned outwardly of the interior surface of the exterior wall and to face the outdoors; and (C) an interior surface that is configured to be positioned inwardly of the interior surface of the exterior wall to define an inwardly projecting alcove within said window between said exterior surface of said window and said interior surface of said window when said frame is mounted to the perimeter of the opening, at least a substantial portion of said interior surface of said window being sufficiently transparent to permit said inwardly projecting alcove to be viewed from within said building.

2. The window as recited in claim 1, wherein said interior surface of said window comprises at least one sash which is at least indirectly supported on said frame and at least a substantial portion of which is spaced inwardly from said frame, said sash supporting at least one transparent pane.

3. The window as recited in claim 1, wherein said frame includes a base that forms a sill of said window and a top that forms a head jam of said window, each of which extends at least from said exterior surface of said window to said interior surface of said window.

4. The window as recited in claim 1, wherein said interior surface of said window is formed from a plurality of sashes that are at least indirectly supported on said frame and that are at least indirectly connected to one another to at least selectively isolate said inwardly projecting alcove of said window from the interior of the building.

5. The window as recited in claim 2, wherein said sash is movable relative to the remainder of said window to selectively allow access to said inwardly projecting alcove of said window from within the building.

6. The window as recited in claim 3, wherein a surface of at least one of said sill and said head jam that faces said inwardly projecting alcove is formed from a relatively smooth, wipable material.

7. The window as recited in claim 6, wherein said material is selected from the group consisting of marble, a faux marble, vinyl and a tile.

8. The window as recited in claim 3, wherein said window is configured to be additionally supported on the building by at least one of a) a stand configured to the located adjacent the interior surface of the wall and to be attached to said base and b) a strut configured to be attached to an interior surface of the building and to at least one of said base of said window and said top of said window.

9. A window configured for permanent mounting in an opening in an exterior wall of a building, the wall having an interior surface and an exterior surface, said window comprising:

(A) a frame configured to be permanently mounted to a perimeter of the opening;

(B) an at least partially open exterior surface that is configured to be positioned outwardly of the interior surface of the exterior wall and to face the outdoors; and (C) an interior surface that is configured to be positioned inwardly of the interior surface of the exterior wall to define an inwardly projecting alcove within said window between said exterior surface of said window and said interior surface of said window when said frame is mounted to the perimeter of the opening, at least a substantial portion of said interior surface of said window being sufficiently transparent to permit said inwardly projecting alcove to be viewed from within said building, wherein said frame includes a base that forms a sill of said window and a top that forms a head jam of said window, each of which extends at least from said exterior surface of said window to said interior surface of said window, and wherein said base comprises said sill, a securing platform located beneath said sill, a plurality of horizontal supports spanning a gap between said securing platform and said sill and supporting said sill on said securing platform, and insulation located within said gap.

10. A window configured for permanent mounting in an opening in an exterior wall of a building, the wall having an interior surface and an exterior surface, said window comprising:

(A) a frame configured to be permanently mounted to a perimeter of the opening;

(B) an at least partially open exterior surface that is configured to be positioned outwardly of the interior surface of the exterior wall and to face the outdoors; and (C) an interior surface that is configured to be positioned inwardly of the interior surface of the exterior wall to define an inwardly projecting alcove within said window between said exterior surface of said window and said interior surface of said window when said frame is mounted to the perimeter of the opening, at least a substantial portion of said interior surface of said window being sufficiently transparent to permit said inwardly projecting alcove to be viewed from within said building, wherein said frame includes a base that forms a sill of said window and a top that forms a head jam of said window, each of which extends at least from said exterior surface of said window to said interior surface of said window, and wherein said top includes a head jam, a securing platform located above said head jam, a plurality of horizontal supports spanning a gap between said securing platform and said head jam, and insulation located within said gap.

11. The window as recited in claim 1, wherein said window is configured to project at least 6" past the interior surface of the wall.

12. The window as recited in claim 1, wherein the window is configured to project at least 16" past the inner surface of the wall.

* * * * *